US006838813B2

(12) United States Patent
Blohm et al.

(10) Patent No.: US 6,838,813 B2
(45) Date of Patent: Jan. 4, 2005

(54) LOW-PRESSURE DISCHARGE LAMP WITH A DEVICE FOR SWITCHING IT OFF AT THE END OF ITS SERVICE LIFE

(75) Inventors: Bernhard Blohm, Königsbrunn (DE); Kirsten Fuchs, Mering (DE); Achim Hilscher, Friedberg-Stätzling (DE); Peter Husslein, Günzburg (DE); Gerald Hämmer, Königsbrunn (DE); Andreas Maciejewski, Maltingen (DE); Thomas Noll, Kipfenberg (DE); Klaus Pankratz, Zusmarshausen (DE); Klaus Weingärtner, Augsburg (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 9 days.

(21) Appl. No.: 10/423,006

(22) Filed: Apr. 25, 2003

(65) Prior Publication Data

US 2004/0012333 A1 Jan. 22, 2004

(30) Foreign Application Priority Data

Apr. 26, 2002 (DE) ..... 102 18 827

(51) Int. Cl.[7] ..... H01J 1/62

(52) U.S. Cl. ..... 313/491; 313/493; 313/631; 313/634; 313/635

(58) Field of Search ..... 313/491, 493, 313/631, 634, 635

(56) References Cited

U.S. PATENT DOCUMENTS 5,585,693 A * 12/1996 Shaffer ..... 313/489
5,705,887 A 1/1998 Shaffer

* cited by examiner

*Primary Examiner*—Vip Patel
(74) *Attorney, Agent, or Firm*—Carlo S. Bessone

(57) ABSTRACT

The invention relates to a low-pressure discharge lamp, having a tubular discharge vessel made from glass, the free ends of which are closed off in a gas tight manner, two electrode systems (3) each having a filament (7), two supply conductors (5, 6) and a bead (8) of glass, the ends of the supply conductors (5, 6) being fused into the ends of the discharge vessel which have been closed off in a gas tight manner and, in order to be held in a region between the filament (7) and the discharge vessel fused seal (2), into the bead (8), and a device for switching off the lamp at the end of its service life, comprising a paste (9) which contains a metal hydride and is fitted to the bead (8). According to the invention, the bead (8) consists of a glass material which has a resistivity of greater $10^8$ Ωcm at 350° C. Moreover, the paste (9) containing the metal hydride is applied to the bead (8) in the radiation shadow with respect to the thermal radiation which emanates from the filament (7) of the lamp in operation, and is not in electrical contact with the supply conductor wires (5, 6) on the bead (8).

11 Claims, 1 Drawing Sheet

LOW-PRESSURE DISCHARGE LAMP WITH A DEVICE FOR SWITCHING IT OFF AT THE END OF ITS SERVICE LIFE

TECHNICAL FIELD

The invention relates to a low-pressure discharge lamp, having a tubular discharge vessel made from glass, the free ends of which are closed off in a gas tight manner, two electrode systems each having a filament, two supply conductors and a bead of glass, the ends of the supply conductors being fused into the ends of the discharge vessel which have been closed off in a gas tight manner and, in order to be held in a region between the filament and the discharge vessel fused seal, into the bead, and a device for switching off the lamp at the end of its service life, comprising a paste which contains a metal hydride and is fitted to the bead.

BACKGROUND ART

U.S. Pat. No. 5,705,887 has disclosed a low-pressure discharge lamp of this type. At the end of the service life of the low-pressure discharge lamp, when the filament breaks or the emitter material has been consumed, the lamp switches over to cold-cathode operation, which leads to an increase in the cathode fall voltage and therefore to considerable heating of the metal parts in the lamp. The considerable increase in the temperature of the metal parts leads to the metal hydride in the paste which is arranged in the area of radiation from the filament and in contact with the supply conductors on the glass bead breaking down. The decomposition of the metal hydride, in particular titanium hydride, leads to hydrogen being released and the discharge being extinguished on account of the increasing operating voltage of the lamp.

Arranging the paste which contains metal hydride in the region of the radiation from the filament and in thermal contact with the supply conductors leads to reliable release of the hydrogen and therefore to the lamp being extinguished at the end of its service life. However, it has been found that a design of this type can lead to premature failure of the low-pressure discharge lamp if it is operated at a ballast which allows the filament heating current to rise during the preheating phase until the lamp has ignited. In this case, the rise in the filament radiation and the heating of the supply conductors can lead to premature decomposition of the metal hydride. Then, the hydrogen released extinguishes the lamp before it reaches the end of its service life as a result of emitter consumption.

DISCLOSURE OF THE INVENTION

Therefore, it is an object of the invention to provide a lamp having a device for switching off the low-pressure discharge lamp at the end of its service life, in which premature failures resulting from high filament heating currents in the ballast are prevented.

This object is achieved by a low-pressure discharge lamp, having a tubular discharge vessel made from glass, the free ends of which are closed off in a gas tight manner, two electrode systems each having a filament, two supply conductors and a bead consisting of a glass material having a resistivity of greater than $10^8$ Ωcm at 350° C., the ends of the supply conductors being fused into the ends of the discharge vessel which have been closed off in a gas tight manner and, in order to be held in a region between the filament and the discharge vessel fused seal, into the bead, a device for switching off the lamp at the end of its service life, comprising a paste which contains a metal hydride, is applied to the bead in the radiation shadow with respect to the thermal radiation which emanates from the filament of the lamp in operation and during filament preheating and is not in electrical contact with the supply conductor wires on the bead.

Particularly advantageous configurations are given in the dependent claims.

The use of a material which has a resistivity of greater than $10^8$ Ωcm at 350° C. for the bead makes it possible to ensure that the material of the bead does not become conductive at up to the decomposition temperature of the metal hydride. Heating of the metal hydride caused by direct heat conduction is substantially suppressed.

Furthermore, according to the invention the paste containing the metal hydride is applied to the bead in the radiation shadow with respect to the thermal radiation which emanates from the filament of the lamp in operation. This makes it possible to prevent the paste and therefore the metal hydride from being heated up by the direct action of heat from the filament. Moreover, the paste is applied to the bead in such a way that it is not in electrical contact with the supply conductor wires. This substantially suppresses heat conduction from the supply conductor to the paste.

Therefore, the bead advantageously consists of a potassium barium silicate glass which has a resistivity of greater than or equal to $10^{10}$ Ωcm at 350° C. In this way, the bead is optimally prevented from becoming electrically conductive all the way up to the temperature at which hydrogen is released, namely 400° C.

Furthermore, the glass bead is advantageously not spherical, but rather in the shape of a cylinder or a roll, the axis of which is oriented transversely with respect to the axis of the discharge vessel in this region, the supply conductors being fused in close to the two ends of the cylindrical bead and the paste containing the metal hydride being applied to that part of the bead which is remote from the filament, in the radiation shadow with respect to the filament. A mushroom shape with the cap of the mushroom facing the filament and the paste containing the metal hydride being located below the cap, in the radiation shadow with respect to the filament, is also advantageous. This optimally suppresses heating of the paste and therefore the metal hydride by the radiant heat.

Tests carried out with different shapes and sizes of bead have demonstrated that in the case of a bead in the shape of a cylinder or roll, the circle should advantageously have a diameter d in mm which satisfies the following empirical formula:

$$d > 0.2026 \times m + 1.7617 \text{ where } m \geqq 2 \text{ mg}$$

where m is the quantity of paste containing the metal hydride in mg. Otherwise, the required quantity of paste cannot reliably be arranged in the shadow with respect to the filament and without contact with the supply conductor.

In addition, that point of the bead which is closest to the gas tight closure of the discharge vessel is at a distance of at least 2 mm from this closure. If this condition is not complied with, closing of the discharge vessel during lamp production, with the considerable heat which is produced, can lead to glass sealing to the bead and therefore to the hydrogen being released from the metal hydride compound.

The metal hydride in the paste advantageously contains a metal selected from the group consisting of titanium, zirconium and/or hafnium or a metal alloy selected from the group consisting of titanium-zirconium, titanium-hafnium and/or zirconium-hafnium alloys as metal for the metal hydride.

A particularly suitable paste material for the metal hydride is a rheological additive in a proportion of less than or equal to 50% by weight.

Optimum results can be achieved with a paste which contains titanium hydride $TiH_2$ as metal hydride. Tests have shown that the release of hydrogen increases as the ratio of surface area to volume in the titanium hydride grains increases, and consequently the smaller the grain size of the titanium hydride the more hydrogen is released. It was possible to achieve optimum prevention of the lamp being switched off as a result of hydrogen being released prematurely during the preheating phase by using a paste containing titanium hydride $TiH_2$ which has a mean grain size of greater than 50 $\mu$m.

BRIEF DESCRIPTION OF THE DRAWINGS

The invention is to be explained in more detail below with reference to a plurality of exemplary embodiments. In the drawings.

BEST MODE FOR CARRYING OUT THE INVENTION

Figure 1:
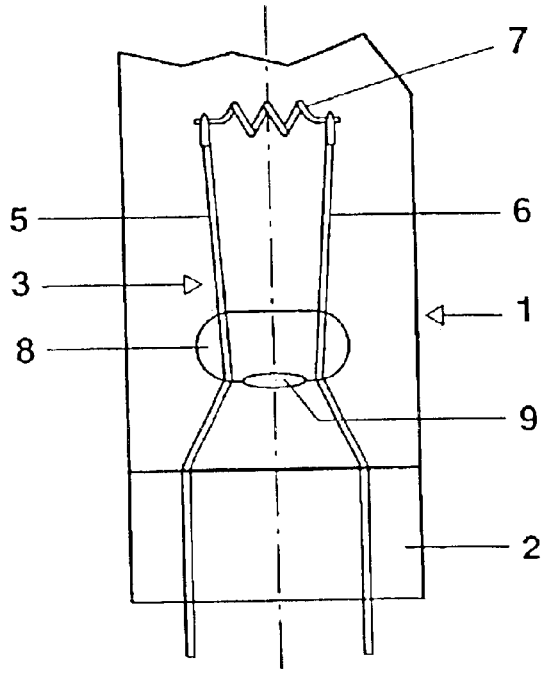
FIG. 1 shows an end of an exemplary embodiment according to the invention of a low-pressure discharge lamp with a bead in the shape of a cylinder or roll.

FIG. 1 shows an end of a first embodiment of a compact low-pressure discharge lamp having a discharge vessel which has been bent a number of times. The ends of the discharge vessel are closed by pinches, the two supply conductors 5, 6 of an electrode system 3 being fused into the end 1 of the discharge vessel which is shown here and has been closed off in a gas tight manner by a pinch 2. The electrode system also comprises a filament 7 and a glass bead 8, which is located approximately in the center between the filament 7 and the pinch 2 and into which the two supply conductors 5, 6 are fused. The glass bead 8 consists of a potassium barium silicate glass and is substantially in the shape of a cylinder or roll with rounded ends, the axis of the cylinder or roll running transversely with respect to the axis of the discharge vessel in this region. The bead 8 has a length of 7 mm and a diameter of 4 mm. The two supply conductors 5, 6 are fused in close to the two ends of the bead 8. A paste 9 comprising a titanium hydride and a rheological additive has been applied to that side of the lateral surface which is remote from the filament 7, the location comprising the paste being located in the shadow with respect to the radiation from the filament 7.

Figure 2:
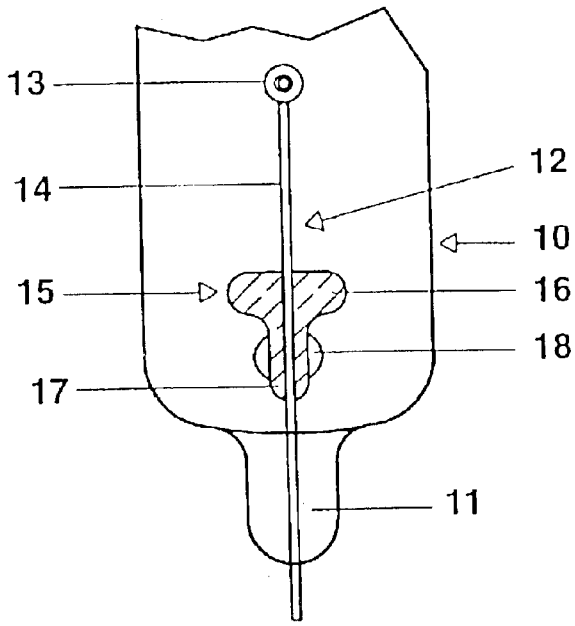
FIG. 2 shows an end of a second exemplary embodiment according to the invention of a low-pressure discharge lamp with a mushroom-shaped bead

FIG. 2 shows a second exemplary embodiment of a discharge vessel end 10 of a compact low-pressure discharge lamp with a similar structure in terms of the electrode system. The end of the discharge vessel 10 with the pinch 11 has in this case been rotated through 90° about its axis. The electrode system 12 with a filament 13 and supply conductors 14 (only one supply conductor is visible in this view) differs from the system shown in FIG. 1 through the fact that in this case the bead 15 of a potassium barium silicate glass is in the shape of a mushroom with a cap 16 and a stem 17, the cap 16 facing the filament 13. Consequently, the paste 18 containing the titanium hydride, which has been applied to both sides of the stem 17 below the cap 16, is in the shadow with respect to the radiation from the filament 13.

What is claimed is:

1. A low-pressure discharge lamp, having a tubular discharge vessel made from glass, the free ends of which are closed off in a gas tight manner, two electrode systems each having a filament, two supply conductors and a bead consisting of a glass material having a resistivity of greater than $10^8$ Ωcm at 350° C., the ends of the supply conductors being fused into the ends of the discharge vessel which have been closed off in a gas tight manner and, in order to be held in a region between the filament and the discharge vessel fused seal, into the bead, a device for switching off the lamp at the end of its service life, comprising a paste which contains a metal hydride, is applied to the bead in the radiation shadow with respect to the thermal radiation which emanates from the filament of the lamp in operation and during filament preheating and is not in electrical contact with the supply conductor wires on the bead.

2. The low-pressure discharge lamp as claimed in claim 1, wherein the bead consists of a potassium barium silicate glass.

3. The low-pressure discharge lamp as claimed in claim 1, wherein the bead is substantially in the shape of a cylinder or roll, the axis of which is oriented transversely with respect to the axis of the discharge vessel in this region, and the supply conductors are fused in close to the two ends of the bead, and the paste containing the metal hydride is applied to that part of the bead which is remote from the filament, in the radiation shadow with respect to the filament.

4. The low-pressure discharge lamp as claimed in claim 3, wherein the bead, if it is substantially in the shape of a cylinder or roll, has a circle diameter d in mm which satisfies the following empirical formula:

$$d>0.2026\times m+1.7617 \text{ where } m\geqq 2$$

where m is the required quantity of the paste containing the metal hydride in mg.

5. The low-pressure discharge lamp as claimed in claim 1, wherein the bead is mushroom-shaped, the cap of the mushroom facing the filament and the paste containing the metal hydride being applied underneath the cap in the radiation shadow with respect to the filament.

6. The low-pressure discharge lamp as claimed in claim 1, wherein that point of the bead which is closest to the gas tight closure of the discharge vessel is at a distance of at least 2 mm from the gas tight closure.

7. The low-pressure discharge lamp as claimed in claim 1, wherein the metal of the metal hydride in the paste consists of a metal selected from the group consisting of titanium, zirconium and hafnium.

8. The low-pressure discharge lamp as claimed in claim 1, wherein the metal of the metal hydride in the paste consists of a metal alloy selected from the group consisting of the titanium-zirconium, titanium-hafnium and/or zirconium-hafnium alloys.

9. The low-pressure discharge lamp as claimed in claim 7, wherein the paste contains titanium hydride $TiH_2$ as metal hydride.

10. The low-pressure discharge lamp as claimed in claim 9, wherein the paste contains titanium hydride $TiH_2$ with a mean grain size of greater than 50 $\mu$m as metal hydride.

11. The low-pressure discharge lamp as, claimed in claim 1, wherein the paste, in addition to the metal hydride, also contains a rheological additive in a quantitative proportion of less than or equal to 50% by weight.

* * * * *